US007044112B2

(12) United States Patent
Andrian-Werburg et al.

(10) Patent No.: US 7,044,112 B2
(45) Date of Patent: May 16, 2006

(54) FUEL SUPPLY SYSTEM FOR AN INTERNAL COMBUSTION ENGINE

(75) Inventors: Stephan von Andrian-Werburg, Stuttgart (DE); Klaus Wunderlich, Waiblingen (DE)

(73) Assignee: DaimlerChrysler AG., Stuttgart (DE)

( * ) Notice: Subject to any disclaimer, the term of this patent is extended or adjusted under 35 U.S.C. 154(b) by 0 days.

(21) Appl. No.: 11/106,037

(22) Filed: Apr. 14, 2005

(65) Prior Publication Data

US 2005/0199223 A1 Sep. 15, 2005

Related U.S. Application Data

(63) Continuation-in-part of application No. PCT/EP03/10916, filed on Oct. 2, 2003.

(30) Foreign Application Priority Data

Oct. 15, 2002 (DE) ..... 102 47 936

(51) Int. Cl.
*F02M 33/04* (2006.01)

(52) U.S. Cl. ..... 123/520

(58) Field of Classification Search ..... 123/516, 123/518, 519, 520
See application file for complete search history.

(56) References Cited

U.S. PATENT DOCUMENTS 4,530,210 A * 7/1985 Yamazaki ..... 60/605.1
4,705,007 A * 11/1987 Plapp et al. ..... 123/519
5,172,672 A * 12/1992 Harada ..... 123/520
5,194,075 A * 3/1993 Matsuoka ..... 96/144
5,220,898 A * 6/1993 Kidokoro et al. ..... 123/520
5,375,579 A * 12/1994 Mukai ..... 123/520
5,857,447 A * 1/1999 Shinohara ..... 123/520
6,363,919 B1 * 4/2002 Isobe et al. ..... 123/520
6,405,718 B1 * 6/2002 Yoshioka et al. ..... 123/520

FOREIGN PATENT DOCUMENTS

DE 196 50 517 6/1998
DE 199 47 080 1/2001
DE 100 01 060 7/2001

* cited by examiner

*Primary Examiner*—Thomas Moulis
(74) *Attorney, Agent, or Firm*—Klaus J. Bach

(57) ABSTRACT

In a fuel supply system for an internal combustion engine including a fuel tank with an activated carbon canister in communication therewith for removing hydrocarbons from the fuel tank venting gases, the activated carbon canister is vented selectively by compressed air conducted from a pressurized air supply for the engine through the canister under the control of a valve which, during flushing of the activated carbon canister, blocks the communication line between the fuel tank and the activated carbon canister and by which the fuel vapors are returned to an engine intake manifold via a suction line, or during normal operation of the engine, by air sucked through the activated carbon container to an inlet manifold of the engine. The activated carbon container can be flushed with positive pressure when the engine is operated with supercharging and with negative pressure when the engine is operated in a normally aspirated fashion.

15 Claims, 1 Drawing Sheet

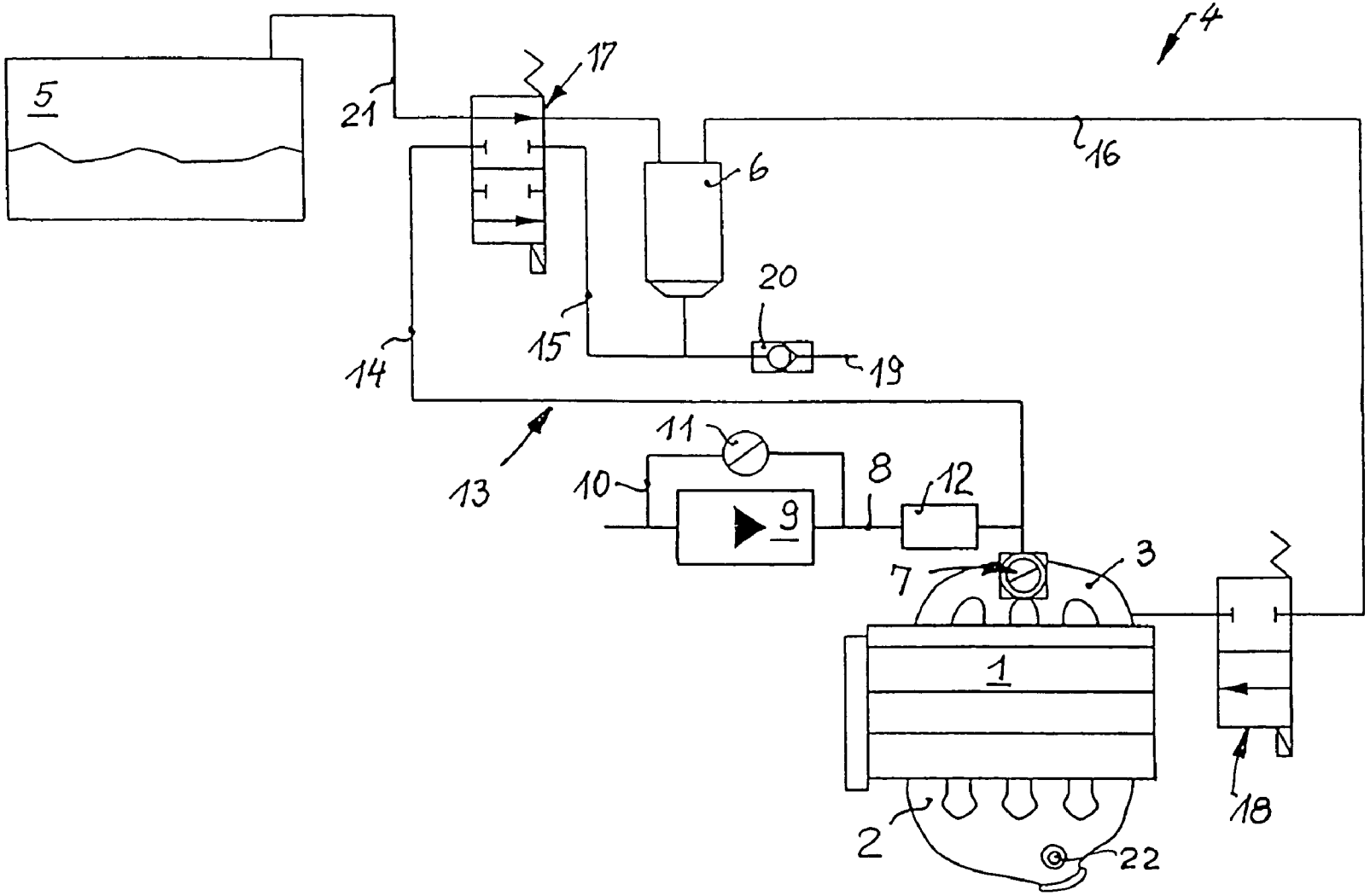
4
16
18
3
22
1
12
7
2
19
8
20
9
6
11
10
17
15
13
21
14
5

FUEL SUPPLY SYSTEM FOR AN INTERNAL COMBUSTION ENGINE

This is a Continuation-In-Part Application of International Application PCT/EP03/10916 filed Oct. 2, 2003 and claiming the priority of German Application 102 47 936.4 filed Oct. 15, 2002.

BACKGROUND OF THE INVENTION

The invention relates to a fuel supply system for an internal combustion engine with a fuel tank and an activated carbon canister for removing fuel vapors from the tank vent gases.

A fuel supply system of the kind mentioned above is known from DE 199 47 080 C1, in which provision is made for the regeneration of the activated-carbon canister by pressure flushing of the activated carbon canister of an internal combustion engine working with air-assisted direct fuel injection. To this end, the pressure source provided for the air-assisted direct fuel injection is a pressure pump which includes a pressure regulator, and the excess quantity branched off via the pressure regulator is supplied to the activated-carbon canister for the regeneration thereof. The air flushed through the activated-carbon canister is, after being charged with hydrocarbons, returned to the air supply duct adjacent to the inlet module via a regeneration valve. While it is true that such a solution makes it possible, via the lambda probe of the internal combustion engine arranged on the exhaust side, to take the hydrocarbons introduced additionally by virtue of the regeneration of the activated-carbon canister into consideration in the determination of the fuel injection quantities, it is nevertheless tied to pressurized flushing of the activated-carbon canister, and thus requires a pressure pump working with an excess air flow, for the regeneration of the activated carbon canister.

It is therefore the object of the present invention is to provide a fuel supply system of the kind referred to in the introduction, but with which the activated-carbon canister can be flushed both, with positive pressure and with negative pressure, so that the regeneration can be carried out independently of the operating states of the internal combustion engine and of pressure sources, and can, as a result, also be used, with only minor modifications, in connection with internal combustion engines which are operated differently, for example internal combustion engines working with a supercharger.

SUMMARY OF THE INVENTION

In a fuel supply system for an internal combustion engine including a fuel tank with an activated carbon canister in communication therewith for removing hydrocarbons from the fuel tank venting gases, the activated carbon canister is vented selectively by compressed air conducted from a pressurized air supply for the engine through the canister under the control of a valve which, during flushing of the activated carbon canister, blocks the communication line between the fuel tank and the activated carbon canister and by which the fuel vapors are returned to an engine intake manifold via a suction line, or during normal operation of the engine, by air sucked through the activated carbon container to an inlet manifold of the engine. The activated carbon container can be flushed with positive pressure when the engine is operated with supercharging and with negative pressure when the engine is operated in a normally aspirated fashion.

To this end, in the fuel supply system according to the invention, the connection of the fuel tank to the atmosphere and the branch from the air supply duct are in each case valve-controlled in the feed line to the activated-carbon canister and are activated alternately for ventilation of the fuel tank and for regeneration of the activated-carbon canister, which—with simple construction—makes it possible, with the branch closed in relation to the activated-carbon canister, to carry out flushing with negative pressure via the valve-controlled connection of the fuel tank to the atmosphere, which runs via the activated-carbon container, and via that portion of the branch which is guided back to the inlet module and in which the regenerating valve is located. Further possibilities in this regard arise in particular when use is made of a mechanically operated valve, in particular a proportional valve, in the outlet of the connection to the atmosphere.

In connection with supercharged engines, it has been found to be advantageous to provide a bypass for the supercharger, whereby the compression pressore can be reduced by slight closing of the associated recirculating valve, so that it is possible, for regeneration, to work with a preferably small positive pressure in relation to the induction pipe pressure—for example up to the order of 150 mbar—for the flushing of the activated-carbon canister even when, despite the supercharger being designed for maximum boost pressures required on the internal combustion engine side, the flushing of the activated-carbon canister and its regeneration take place in operating phases of the internal combustion engine in which only small boost pressures are desired and necessary on the engine side.

The supercharger is preferably arranged upstream of the air-mass flow meter and is preferably a mechanical supercharger.

The alternate establishment of the connection of the fuel tank to the atmosphere and of the feed-side portion of the branch of the air supply system leading into the activated-carbon canister is preferably carried out via a common directional control valve, the directional control valve being designed in particular as a 4/2-way valve. Generally, such a simplified solution is also possible by flushing with negative pressure with the connection of the activated-carbon canister open to the fuel tank without the fuel tank being endangered by high negative pressure loading. Within the scope of the invention, however, use can also be made of a 4/3-way valve with an additional position, in which all connections are closed, so that the activated-carbon canister is shut off both in relation to the tank and in relation to the portion of the branch starting from the inlet module, and the air for flushing the activated-carbon canister is taken in exclusively via the connection of the activated-carbon canister to the atmosphere.

The invention will become more readily apparent from the following description of an illustrative embodiment, shown by way of example only in the accompanying drawing.

BRIEF DESCRIPTION OF THE DRAWING

The sole FIGURE shows a fuel supply system for an internal combustion engine according to the invention.

DESCRIPTION OF A PREFERRED EMBODIMENT

In the drawing, reference number 1 designates an internal combustion engine, here an internal combustion engine working with spark ignition, which has an exhaust manifold 2 and an inlet manifold 3. A fuel supply system 4 is connected to the inlet manifold 3 which comprises a fuel tank 5 and an activated-carbon canister 6. Connected to the inlet manifold 3 is a throttle valve 7 on the incoming side and associated with the throttle valve 7 is an air supply duct 8, in which, as the pressure source 9, a supercharger is located. A bypass line 10 with a recirculating valve 11 extends around the supercharger 9. An air-mass meter 12, which is preferably a hot-film air-mass flow meter, is located in the air supply duct 8 following the pressure source 9, that is downstream of the pressure source 9, in the flow direction toward the inlet manifold 3. The connection for a branch 13, which comprises sections 14, 15 and 16, of which the section 14 is connected to a directional control valve 17 designed here as a 4/2-way valve, is located between the air-mass flow meter 12 and the connection of the air supply duct 8 to the inlet module 3. The directional control valve 17 is located at the transition to the section 15 of the branch 13, which is connected to the activated-carbon canister 6, from which the section 16 extends. In the portion 16, as the regenerating valve 18, a 2/2-way valve is arranged and, following the regenerating valve 18, the section 16 leads to the inlet module 3, preferably adjacent to one or more of the induction ports of the internal combustion engine 1. In principle, the air-mass meter can also be arranged upstream of the pressure source within the scope of the invention, as the entire air mass flow can also be detected in that way, if the supercharger does not have a blow-off valve.

Connected in parallel with the portion 15 of the branch 13 is a connecting line 19 to the atmosphere which extends from to the activated-carbon canister 6 and includes a non-return valve 20 for closing the connecting line 19 (illustrated in simplified form). Connected in parallel with that section 16 of the branch 13 starting from the activated-carbon canister 6, a connection 21, via the directional control valve 17 to the fuel tank 5. The directional control valve 17 has two operating positions, in one of which, which is the basic position, the connecting line 21 between fuel tank 5 and activated-carbon canister 6 is established through the connection between the sections 14 and 15 of the branch 13 is interrupted, and in the second of which, which is switched by an actuator, the connection of the fuel tank 5 to the activated-carbon canister 6 is interrupted and the sections 14 and 15 of the branch 13 are connected.

The regenerating valve 18 is shown in its first operating position, which constitutes a basic position and in which the connection via the section 16 of the branch 13 is interrupted, However, the valve 17 can be switched over via an actuator to the second operating position, in which this connection is open.

The non-return valve 20 can also be a mechanically operated valve within the scope of the invention.

With the arrangement of the fuel supply system 4 the flushing and thus the regeneration of the activated-carbon canister 6 can take place both with positive pressure and with negative pressure, and is thus also independent in its functioning of the operation of the supercharger as the pressure source 9. Consequently, the system is also suitable for internal combustion engines 1 which work with a connectable supercharger. The system can thus also be used, for example in connection with vehicles that may be equipped with different types of engines in essentially the same way or, if appropriate, a scaled-down arrangement so that the need for a large variety of parts is greatly reduced in spite of varying applications.

If the fuel supply system 4 is operated with positive pressure with respect to the regeneration of the activated-carbon canister 6, the fresh air taken in via the super-charger as the pressure source 9 is compressed to a small extent by slight closing of the recirculating valve 11 before it flows via the air-mass meter 12 to the internal combustion engine 1 via the throttle valve 7. Some of the pre-compressed air is branched off from the air supply duct 8 between the air-mass meter 12 and the throttle valve 7 and is supplied to the activated-carbon canister 6 via the portion 14 of the branch 13, the directional control valve 17, which has for the regeneration been switched into operating position 2, and the line portion 15. After flowing through the activated-carbon canister 6 the air is returned to the inlet module 3 via the secion 16 of the branch 13 while the regenerating valve 18 is switched to its second operating position, the line section 16 being preferably connected to the region of the induction ports of the internal combustion engine 1 in order to utilize the negative pressure present there.

In order to keep the air mass supplied to the internal combustion engine 1 constant in the regeneration phase in relation to the operating point concerned, the opening angle of the throttle valve 7 is reduced accordingly, and the flushing air flow enriched with hydrocarbons additionally supplied to the engine is thus compensated for.

In view of the fact that the entire air mass flow passing via the air supply duct 8 is detected by the air-mass flow meter 12 and the outlet manifold 2 is provided with a lambda probe 22 for detecting the exhaust gas composition, the loading state of the activated-carbon canister 6 can be determined immediately during regeneration by virtue of the lambda shift. As a result, in view of the very short response times, the loading state of the activated-carbon canister 6 does not have to be detected in advance of, or during, a regeneration phase and taken into consideration with respect to its contribution to the mixture ratio. During the flushing of the activated-carbon canister 6 with positive pressure, the branch 13 is shut off in relation to the atmosphere via the non-return valve 20, via which in the operating position 1 (shown) of the directional control valve 17, the ventilation of the fuel tank 5 takes place outside the regeneration phases.

Furthermore, the basic arrangement of the fuel supply system 4 also permits flushing with negative pressure when the pressure source 9 is inactive by utilizing the pressure gradient which exists between the pressure present on the inflow side of the throttle valve 7 (air supply duct 8) and on the inflow side of the induction ports of the inlet manifold 3 (portion 16 of the branch 13). In the second operating position of the regenerating valve 18 for carrying out the regeneration, the directional control valve 17 is switched into its second operating position, in which the fuel tank 5 is shut off in relation to the activated-carbon canister 6, so that negative pressure does not act on the fuel tank 5. In particular in connection with such a solution, it is advantageous if the valve 20 in the connecting line 19 is a switched valve, so that, for flushing with negative pressure, the entire air quantity supplied on the inlet side to the internal combustion engine 1 passes via the air-mass flow meter 12. When such a switched valve 20 is used outside the regeneration phases, an opening position in relation to the atmosphere which is switched and/or adjusts itself preferably in a pressure-controlled manner corresponds to the first operating position of the directional control valve 17, so that the fuel tank 5 is ventilated as required via the activated-carbon canister 6.

The invention claimed is:

1. A fuel supply system for an internal combustion engine (1), comprising a fuel tank (5), an activated-carbon canister (6), an inlet manifold (3) on the internal combustion engine (1), an air supply duct (8) leading to the inlet manifold (3), and an air-mass flow meter (12) arranged in the air supply duct (8) and a valve (17) for controlling the connection of the fuel tank (5) to the atmosphere via the activated-carbon canister (6) and, downstream of the air-mass flow meter (12), a branch (13) extending from the air supply duct (8) back to the inlet manifold (3) via the activated-carbon canister (6), the branch (13) inlcuding a mechanically operated regenerating valve (18) downstream of the activated-carbon canister (6), the connection (21) of the fuel tank (5) to the atmosphere and the connection of the branch (13) from the air supply duct (8) to the activated-carbon canister (6) being both valve-controlled so as to be activated alternately for ventilation of the fuel tank (5) and for regeneration of the activated-carbon canister (6).

2. The fuel supply system as claimed in claim 1, wherein the air supply duct (8) includes a pressure source (9) upstream of the air-mass flow meter (12).

3. The fuel supply system as claimed in claim 1, wherein the air supply duct (8) includes a pressure source (9) downstream of the air-mass flow meter (12).

4. The fuel supply system as claimed in claim 2, wherein the pressure source (9) is a supercharger.

5. The fuel supply system as claimed in claim 4, wherein the pressure source (9) is provided with a bypass (10) including a recirculating flow control valve (11).

6. The fuel supply system as claimed in claim 4, wherein the pressure source (9) is a mechanical supercharger.

7. The fuel supply system as claimed in claim 4, wherein the pressure source (9) is a compressor of an exhaust gas turbocharger.

8. The fuel supply system as claimed in claim 1, wherein the connection (21) of the fuel tank (5) to the activated-carbon canister (6) and the branch (13) from the air supply duct (8) to the activated-carbon canister (6) are controlled together via a directional control valve (17).

9. The fuel supply system as claimed in claim 8, wherein the directional control valve (17) is a 4/2-way valve.

10. The fuel supply system as claimed in claim 8, wherein the directional control valve (17) is a 4/3-way valve.

11. The fuel supply system as claimed in claim 1, wherein the activated carbon canister (6) is in communication with the atmosphere via a non-return valve (20).

12. The fuel supply system as claimed in claim 1, wherein the activated carbon canister (6) is in communication with the atmosphere via a mechanically operated valve (20).

13. The fuel supply system as claimed in claim 12, wherein the mechanically operated valve (20) is closed during regeneration of the activated-carbon canister (6) with a negative pressure.

14. The fuel supply system as claimed in claim 1, wherein the internal combustion engine has an exhaust manifold (2) and a lambda probe (22) is arranged in the exhaust manifold (2) such that the entire air mass flow supplied to the internal combustion engine, including the flushing air quantity, is conducted past the lambda probe (22).

15. The fuel supply system as claimed in claim 14, wherein the loading of the activated-carbon filter (6) is detected via the lambda probe (22) during flushing of the activated carbon canister (6).

* * * * *